US008585260B2

(12) United States Patent
Hajee et al.

(10) Patent No.: US 8,585,260 B2
(45) Date of Patent: Nov. 19, 2013

(54) MODULAR ILLUMINATION DEVICE WITH PEDAL GENERATOR

(75) Inventors: Sameer Hajee, Amsterdam (NL); Simon Tremeer, Cape Town (ZA); Barry Whitmill, Cape Town (ZA)

(73) Assignee: Nuru Energy Design and Development, Port Louis (MU)

( * ) Notice: Subject to any disclaimer, the term of this patent is extended or adjusted under 35 U.S.C. 154(b) by 80 days.

(21) Appl. No.: 12/991,092

(22) PCT Filed: May 5, 2009

(86) PCT No.: PCT/US2009/002772

§ 371 (c)(1),
(2), (4) Date: Jun. 30, 2011

(87) PCT Pub. No.: WO2009/137036

PCT Pub. Date: Nov. 12, 2009

(65) Prior Publication Data

US 2012/0026727 A1 Feb. 2, 2012

Related U.S. Application Data

(60) Provisional application No. 61/050,289, filed on May 5, 2008.

(51) Int. Cl.
*F21V 33/00* (2006.01)

(52) U.S. Cl.
USPC ..... 362/427; 362/190; 362/191; 362/219; 362/249.11; 362/192; 362/193

(58) Field of Classification Search
USPC ..... 362/183, 184, 189, 190–193, 196, 197, 362/202, 205, 219, 234, 249.01, 249.02, 362/249.1, 249.11, 427, 647, 652, 657–659
See application file for complete search history.

(56) References Cited

U.S. PATENT DOCUMENTS

| | | | | |
|---|---|---|---|---|
| 6,585,393 | B1 * | 7/2003 | Brandes et al. | 362/235 |
| 2002/0114155 | A1 * | 8/2002 | Katogi et al. | 362/219 |
| 2003/0156408 | A1 * | 8/2003 | Goodman | 362/234 |
| 2008/0198590 | A1 * | 8/2008 | Kuo et al. | 362/219 |

* cited by examiner

*Primary Examiner* — Laura Tso
(74) *Attorney, Agent, or Firm* — Howard & Howard Attorneys PLLC

(57) ABSTRACT

An illumination device of the present invention is used for illuminating an environment, such as a house, a class room, and the like, wherein electricity is in high demand and not affordable to some extent. The illumination device includes at least two units. Each unit presents a male connector and a female connector to mate with one another as more light is required and disassembled from one another to reduce illumination of the environment. A bracket connected to each unit is movable about the unit for placing the unit on a surface, such as a floor, a wall, or a ceiling, and for positioning the unit relative to the environment to be illuminated. A pedal generator capable of attaching and simultaneously charging multiple battery-containing units makes the illumination device useful in areas where electricity is scarce. The illumination device is cost effective and easy to manufacture, transport, and assemble.

16 Claims, 11 Drawing Sheets

FIG. 12
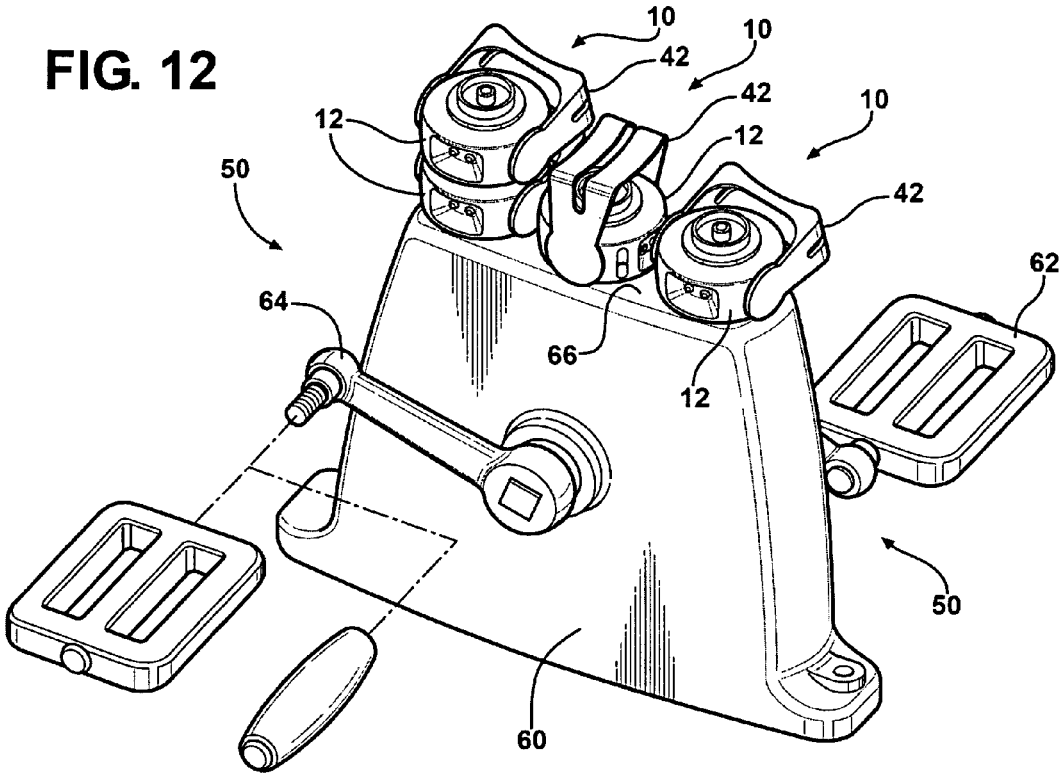
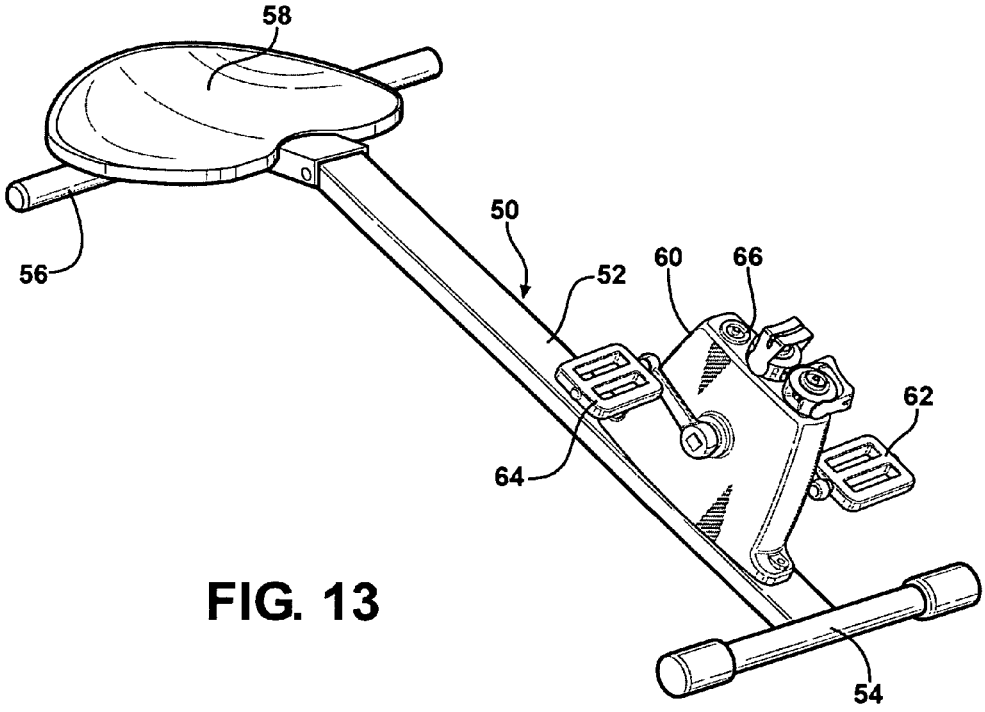
FIG. 13

MODULAR ILLUMINATION DEVICE WITH PEDAL GENERATOR

RELATED APPLICATIONS

This application claims priority to and all the benefits of International Application No. PCT/US2009/002772, which was filed on May 5, 2009 with the World Intellectual Property Organization, which in turn claims priority to a provisional application Ser. No. 61/050,289 filed on May 5, 2008, the disclosures of which are hereby incorporated by reference.

FIELD OF THE INVENTION

The present invention relates to an illumination device, such as flash lights and the like.

BACKGROUND OF THE INVENTION

Multiple places around the globe either have shortages in electricity supply or no electricity supply at all. Developing countries typically have fragile economies and experience serious environmental problems, which are associated with and negatively affect the use of energy, thereby making it as non affordable to people in need. Coal-fired and nuclear power stations for electricity generation, coal combustion in the townships, SASOL coal to oil processes, petrol and diesel use in vehicles for mass transportation, and over-exploitation of fuel wood resources all result in serious, long term environmental damage.

Many people in these developing world countries still depend on inefficient traditional energy sources. The most common type of fuel for cooking or lighting in low-income homes is kerosene or wood or other biomass such as dung and crop wastes. Burning of these types of material damages health and has been associated with respiratory diseases and eye problems.

Alluding to the above, land degradation and deforestation continue to grow as people in need of fuel sources cut down trees for cooking meals and illuminating their homes. Women and children spend many hours looking for wood; electricity could free up their time for other activities. Electric lighting could also extend study hours for children attending schools.

Prior art is replete with various illumination devices currently used by consumers. U.S. Pat. No. 7,506,999 to Uchida et al. teaches a lighting device that includes a light source in line and a reflector behind the light source. In front of the light source, a transparent inner lens and a transparent outer lens can be provided with a gap formed therebetween. The shape of the lens can be defined by bending a plate member so as to have a projection portion that surrounds or opens towards the light source. The inner lens and the outer lens can each have a flat part at a position opposite the light source and in the illumination direction. The light sources are fixedly arranged in a single lighting pattern wherein each of the light sources is not adjustable relative to one another.

As such, there is a constant need in the area of illumination devices for an improved light device that is cost effective, easy to manufacture, easy to transport and assembly and will eliminate one or more problems as set forth above.

SUMMARY OF THE INVENTION

An illumination or light device of the present invention is used for illuminating an environment, such as a room, a class room, and the like, wherein electricity is in high demand and either not available or not affordable to some extent. The illumination device includes at least one unit or more without limiting the scope of the present invention. Each unit presents a circular housing having a peripheral wall, a top, and a bottom. A depression portion is defined in the peripheral wall. The circular housing is not intended to limit the scope of the present invention. The housing may present a non-circular configuration or any other configuration suitable for various applications.

A pair of super white LEDs or any other light emitting elements are exposed therefrom without limiting the scope of the present invention. The number of LEDs may be changed as required. At least one electro-chemical element (not shown) is disposed therein for providing power to the LEDs, and switch button. The electro-chemical device is exposed to an external source of power such as an AC wall charging device connected to a socket or base station (not shown), a solar panel, an accumulator (not shown), a charger having a single crank or double crank. Several units of the inventive illuminating device are rotatable about one another at different ranges through 360 degrees allowing for example, 90° of concentrated light, 180° of overhead light and 360° of dispersed light as shown in FIG. 3 without limiting the scope of the present invention.

Each unit includes a male connector and a female connector at the top and the bottom, respectively, to mate with one another. The type and configuration of the male and female connectors is not intended to limit the scope of the present invention. A standard DC socket may be disposed within either male or female connectors to electrically connect at least two units with one another. This mating engagement may allow transfer and distribution of power to each connected unit.

A bracket is connected to each unit. The bracket is movable about the unit for placing the unit on a surface, such as floor, wall, or a ceiling and to position the unit relative the environment to be illuminated. The bracket is movable relative the unit and is adaptable to be swinging over a bar, being connected to a hook (via the bottle mount attachment), nailed to a surface, or used with a headstrap and worn around the neck or head as a headlamp. The bracket can be used as a stand allowing one or more attached units to sit on a flat surface and function as a table lamp. If multiple units are attached together in a vertical stack fashion, the bracket of the unit on the top of the stack can function as a handle, much like the handle of a camping lantern. The unit and the bracket are injection molded from a polymeric material but may be formed from other materials without limiting the scope of the present invention.

A generator unit presents a beam having a first end defined by a first bar and a second end defined by a second bar and a seat position relative the second bar. A generator block is position on the beam and is spaced from the seat. The block is adaptable to mechanically generate power by moving pedals without limiting the scope of the present invention. The generator block presents a top portion adaptable for receiving at least one of the units thereby charging the unit with power as the pedals are movable about the generator block for mechanically generating power inside the generator block and translating the same to the units thereby charging the units with power enough to illuminate the environment for sufficient period of time.

An advantage of the present invention is to provide an illumination device is cost effective and easy to manufacture.

Another advantage of the present invention is to provide an illumination device that is easily transportable, compact in its design and can be easily assembled and installed to provide illumination at various angles.

Still another advantage of the present invention is to provide an illumination device that can be manipulated by reducing or increasing the number of units by mechanically mating the units with one another as more light is required and disassembling the units from one another to reduce illumination of the environment.

Still another advantage of the present invention is to provide a cheap solution for every place in the world wherein electricity is in high demand and either not available or not affordable to some extent by everyone who needs it.

Still another advantage of the present invention is that the unit can be worn on a person's head as a directional illuminating device. A head band is attached to the bracket as set forth above.

Still another advantage of the present invention is the use of a bottle mount which is attached to the bracket as set forth above. The bottle mount allows the user to affix the illuminating device to a soft drink or water bottle whereby the bottle becomes a stand.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 12 and 13 illustrate various embodiments of self-propelled charging devices wherein the units are mechanically connected thereto and are charged by a user;

DETAILED DESCRIPTION OF THE PREFERRED EMBODIMENT

Figure 1:
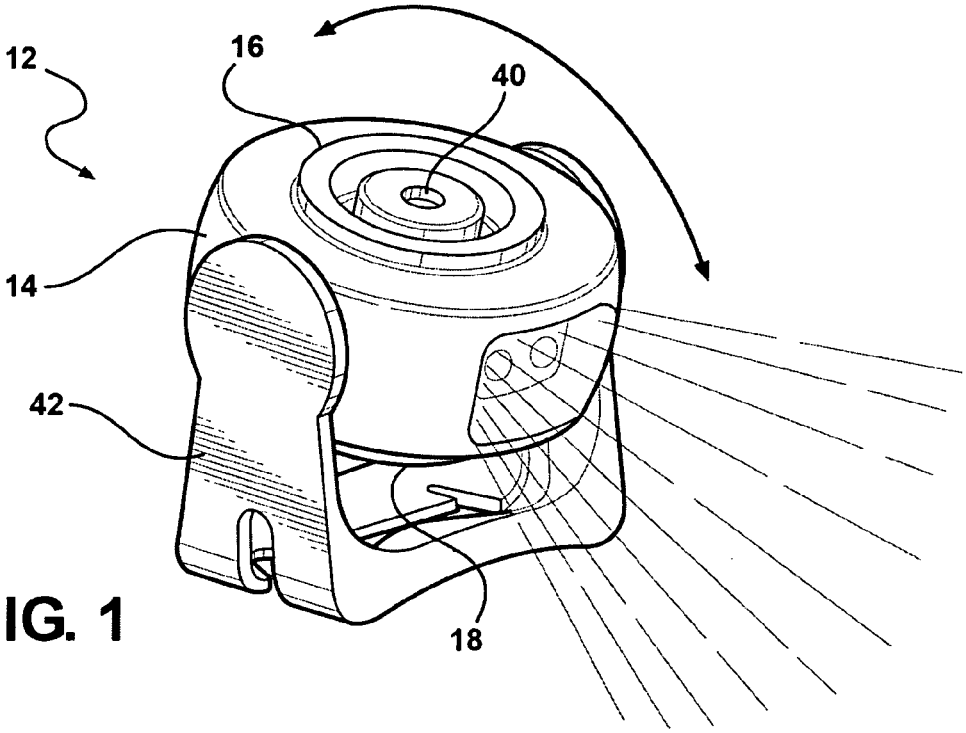
FIG. 1 presents a perspective view of a unit of an inventive illuminating device and a bracket connected to the unit.

Referring to the FIGS. 1 through 5, wherein like numerals indicate like or corresponding parts, an illumination or light unit of the present invention is generally shown at 12. An illumination or light device of the present invention is generally shown at 10 in FIGS. 6 through 11. The illumination device 10 of the present invention is used for illuminating an environment, such as a house, a class room, and the like, wherein electricity is in high demand and not affordable to some extent. The illumination device 10 includes at least two units 12 or more without limiting the scope of the present invention. Each unit 12 presents a circular housing having a peripheral wall 14, a top 16, and a bottom 18. A depression portion 20 is defined in the peripheral wall 14.

A pair of super white LEDs 22 and 24 or any other light emitting elements are exposed therefrom without limiting the scope of the present invention. The number of LED's 22 and 24 may be changed as required. At least one electro-chemical element (not shown) is disposed therein for providing power to the LEDs 22 and 24, and switch button 25. The electro-chemical device is exposed to an external source of power such as a AC wall charging device 30 connected to a socket (not shown), a solar panel 32, an accumulator (not shown), a charger having a single crank 34 or double crank 36 all shown in FIG. 5.

FIGS. 7A through 11 present multiple views of several units 12 of the inventive illuminating device 10 being rotatable about one another at different ranges to provide 90 degrees concentrated light, 180 degrees overhead light, and 360 degrees dispersed light as shown in FIGS. 7A through 9B without limiting the scope of the present invention. Each unit 12 includes a male connector and a female connector at the top 16 and the bottom 18, respectively, to mate with one another.

The type and configuration of the male and female connectors is not intended to limit the scope of the present invention. A standard DC socket 40 may be disposed within either male or female connectors to electrically connect at least two units 12 with one another. This mating engagement may allow transfer and distribution of power from the unit 12 having high power balance to the unit 12 having low power balance.

Figure 2:
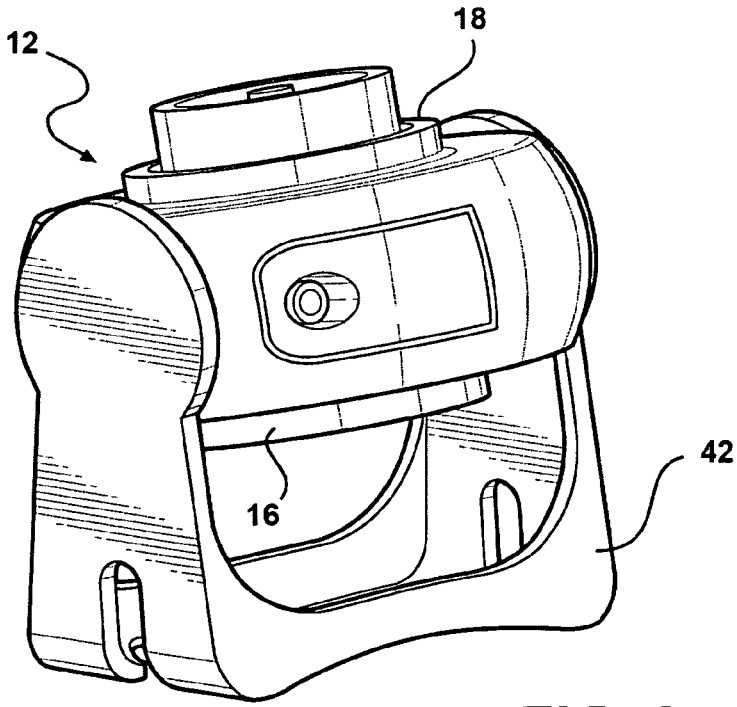
FIG. 2 presents another perspective view of the unit of the inventive illuminating device.
Figure 3:
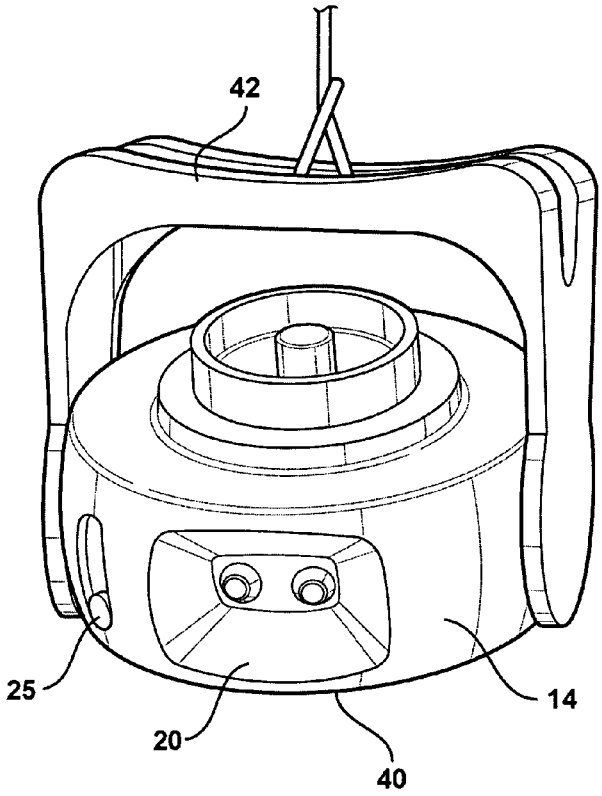
FIG. 3 presents a perspective view of the unit connected to a rod hanging from a surface.
Figure 4:
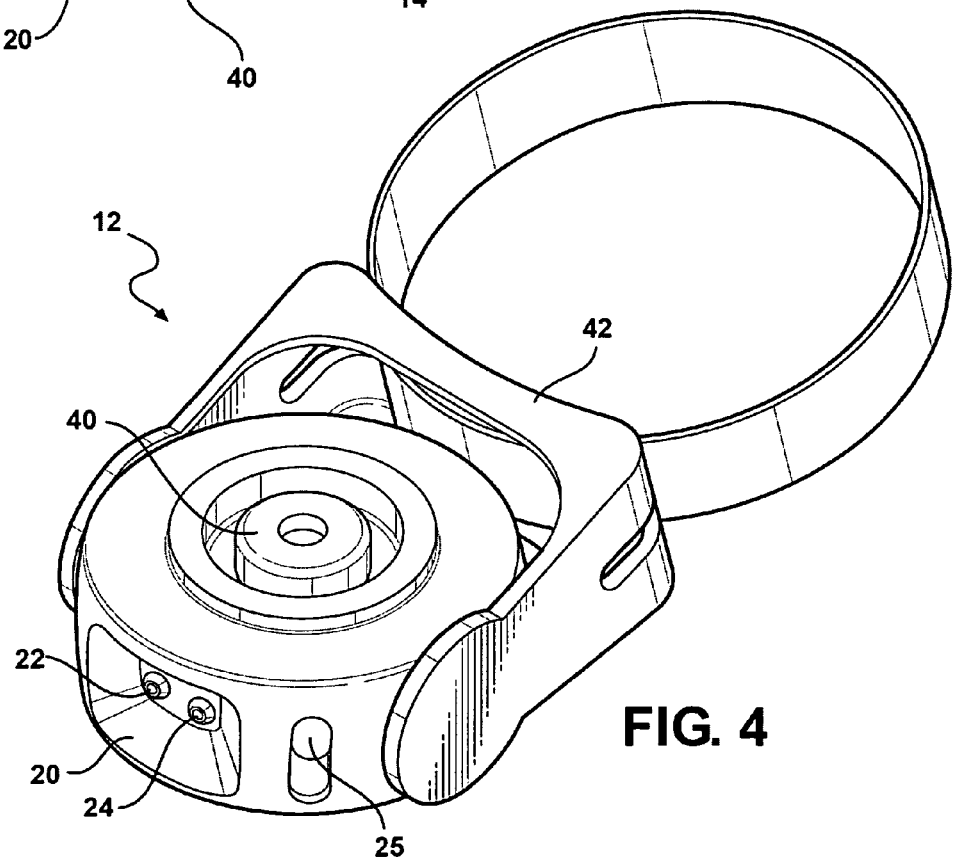
FIG. 4 is a perspective view of the unit having a ring extending through the bracket wherein the ring can be used to circumscribe the beam and the like and also can be worn by a user around the neck and other ports of the body.
Figure 5:
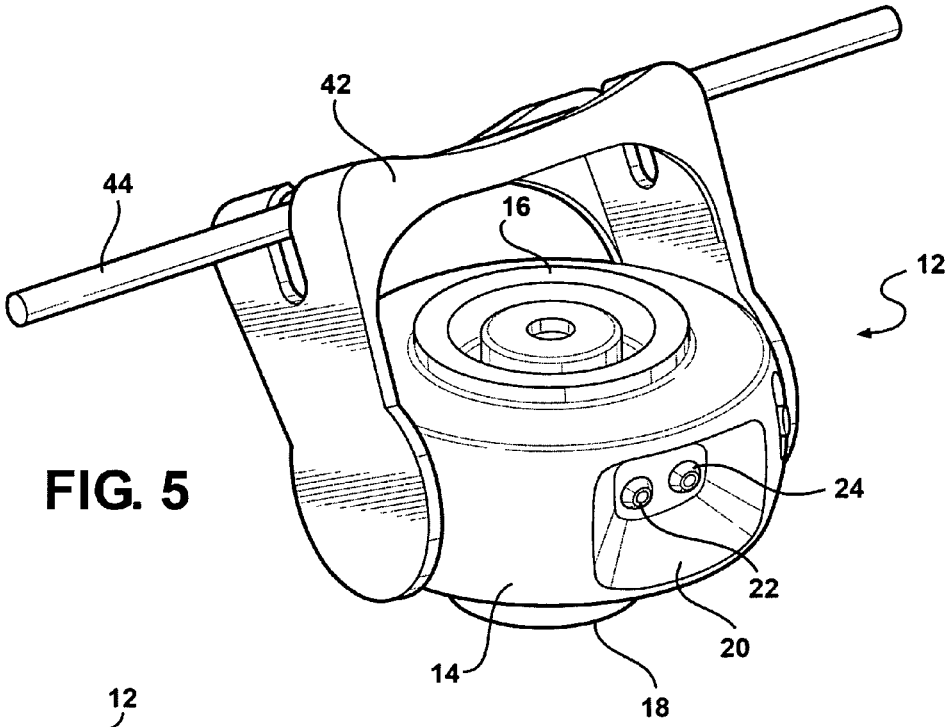
FIG. 5 is another perspective view of the unit having a rod extending through the bracket.
Figure 6:
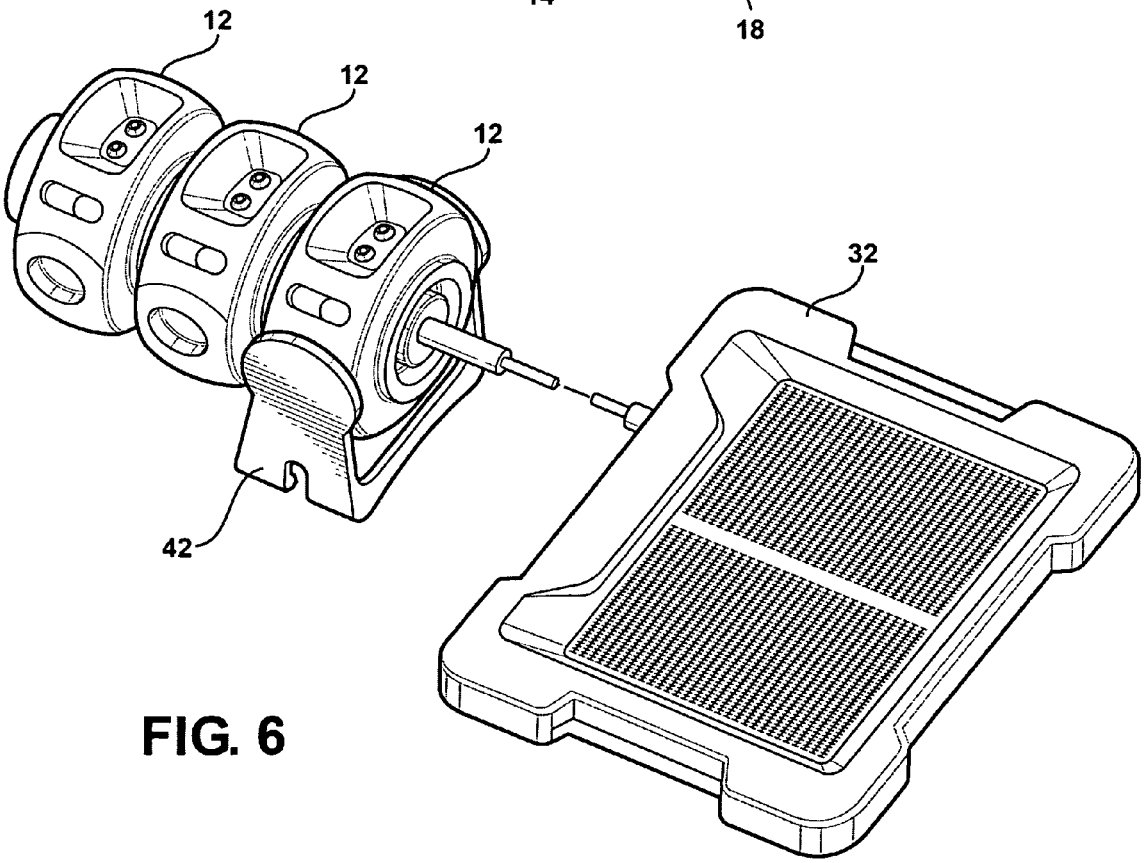
FIG. 6 is another perspective view wherein a plurality of units are connected with one another and powered by a solar panel.
Figure 7A:
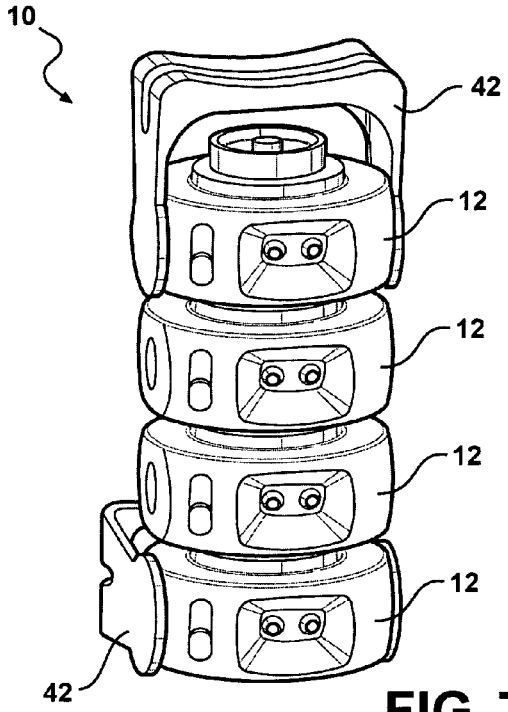
FIGS. 7A through 9B present multiple views of several units of the inventive illuminating device rotatable about one another from 0 to 360 degrees ranges, where the devices are shown to provide 90 degrees concentrated light, 180 degrees overhead light, and 360 degrees dispersed light.
Figure 7B:
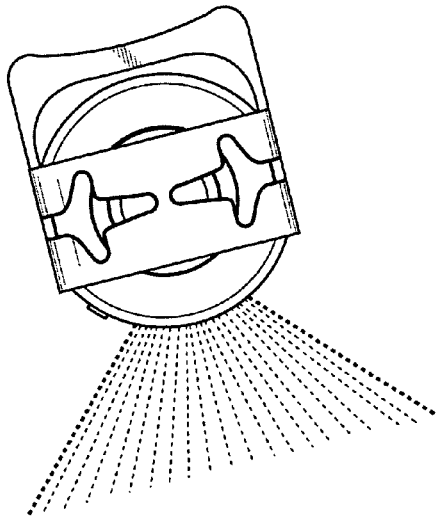
Figure 8A:
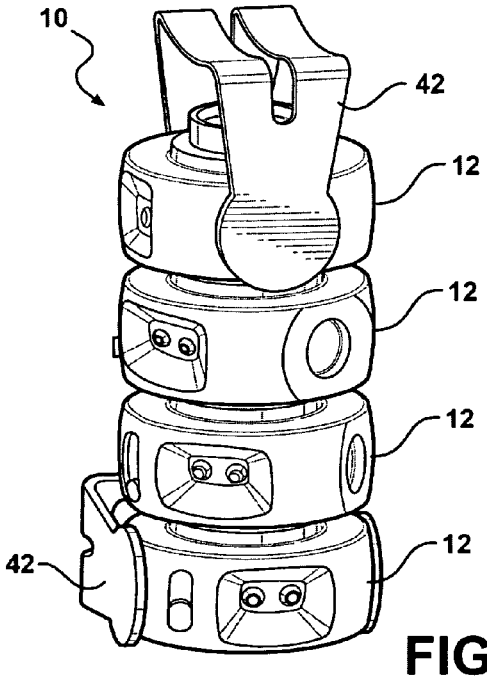
Figure 8B:
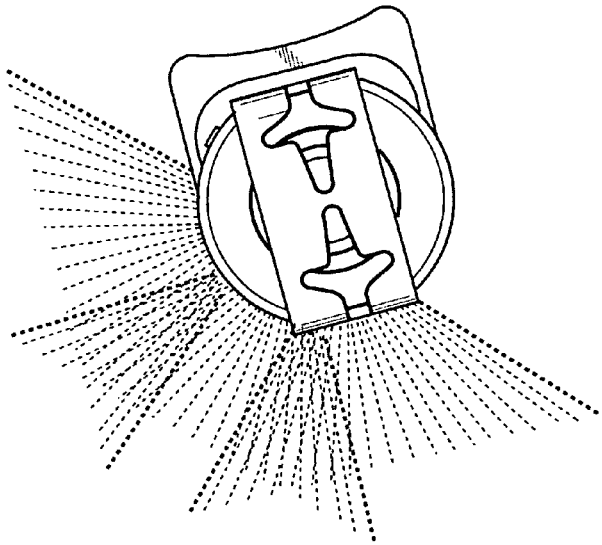
Figure 9A:
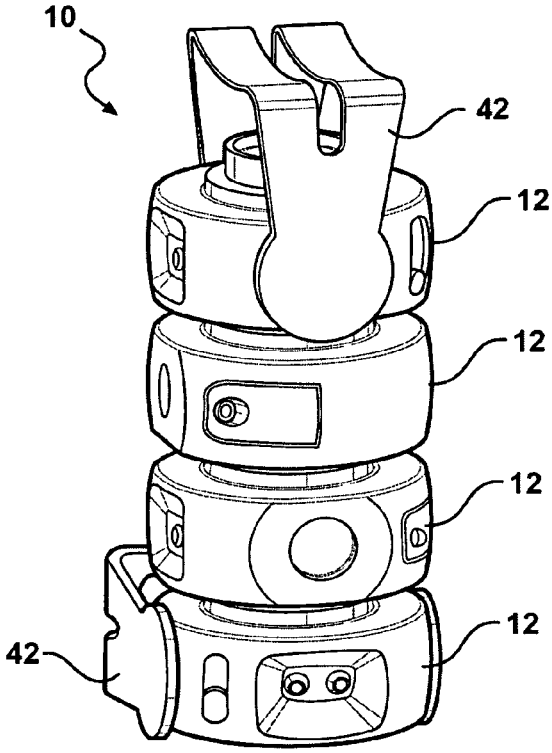
Figure 9B:
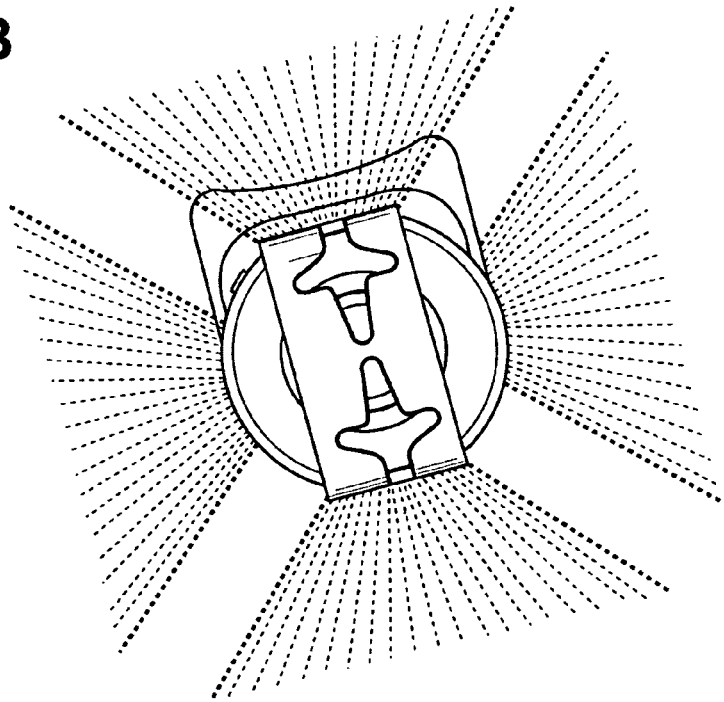
Figure 10:
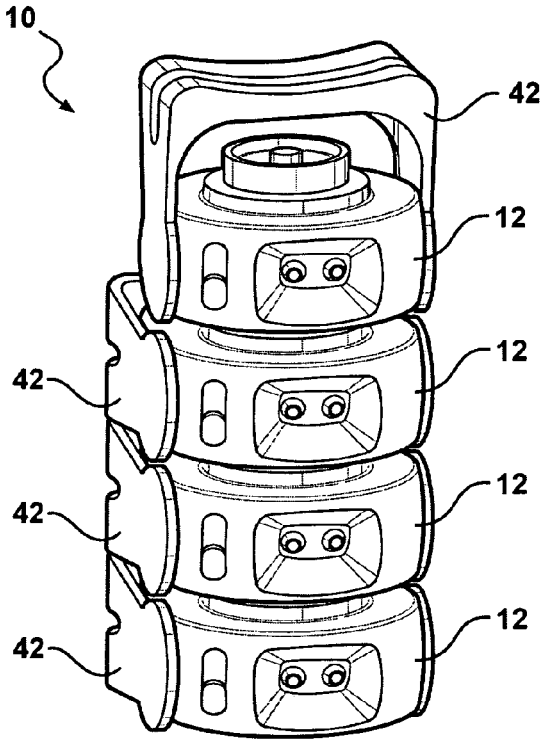
FIGS. 10 and 11 present yet other perspective views of the illuminating device.
Figure 11:
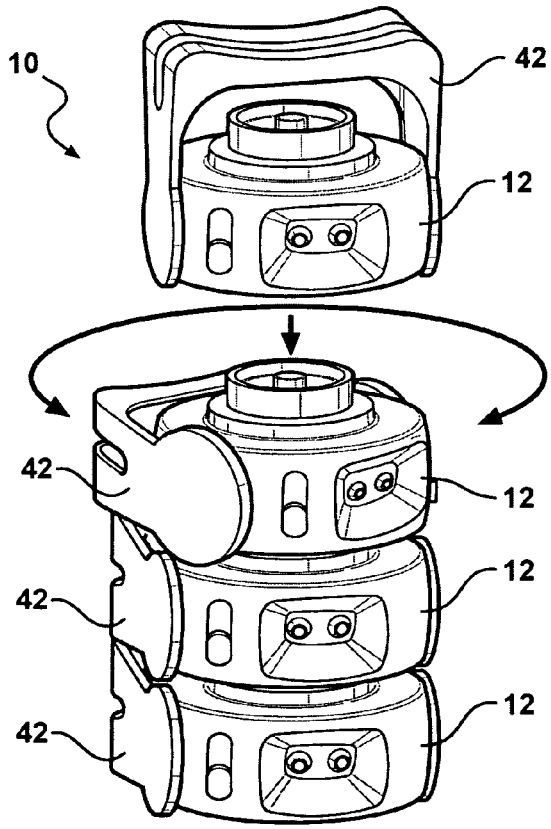
Figure 14:
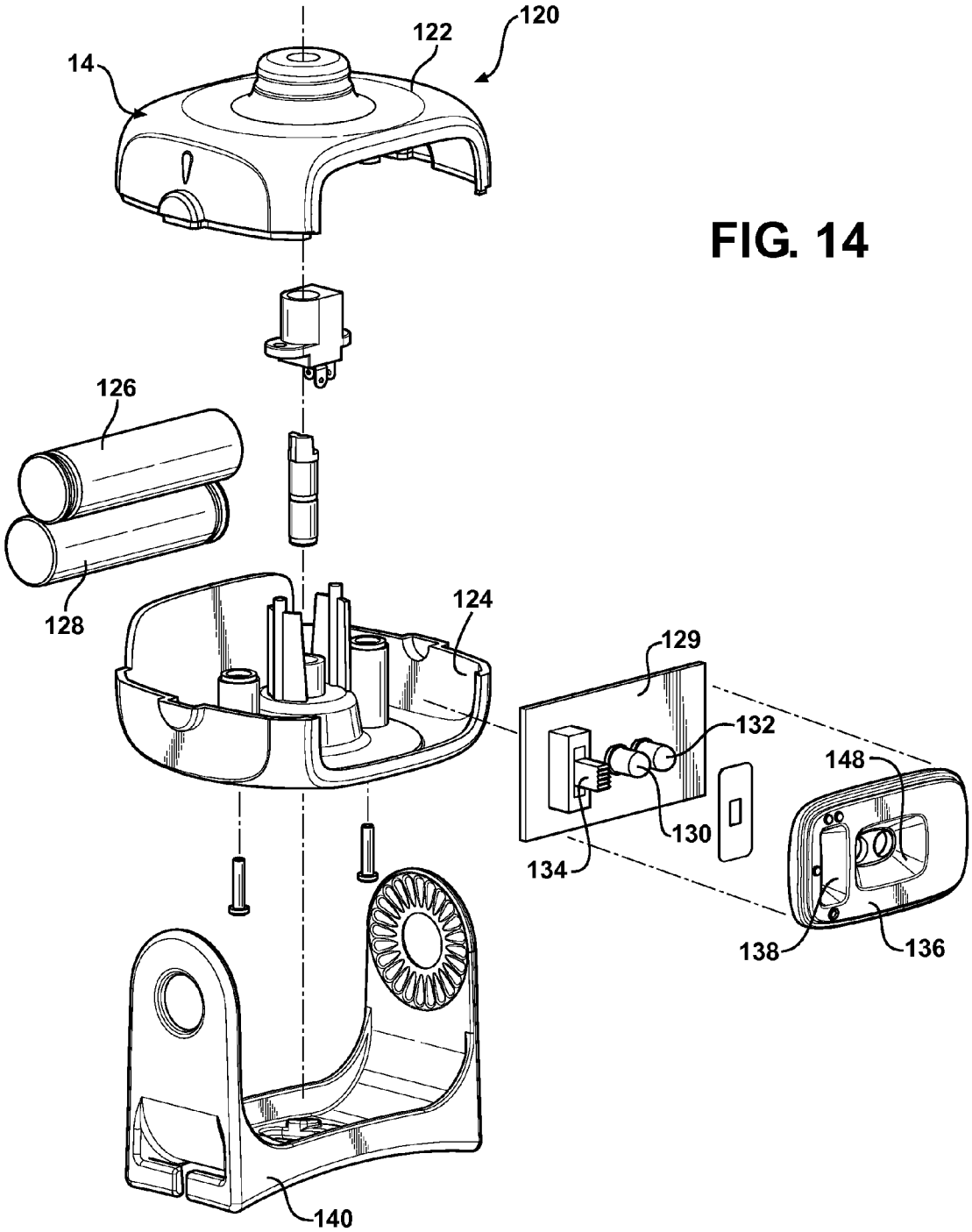
FIG. 14 illustrates an exploded view of another alternative embodiment of the unit.
Figure 15:
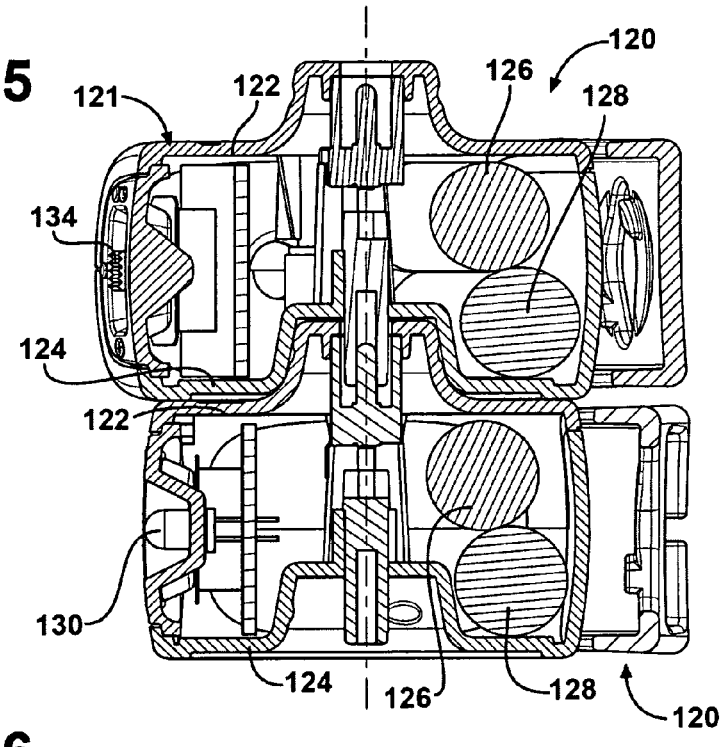
FIG. 15 illustrates a cross sectional view of the unit.
Figure 16:
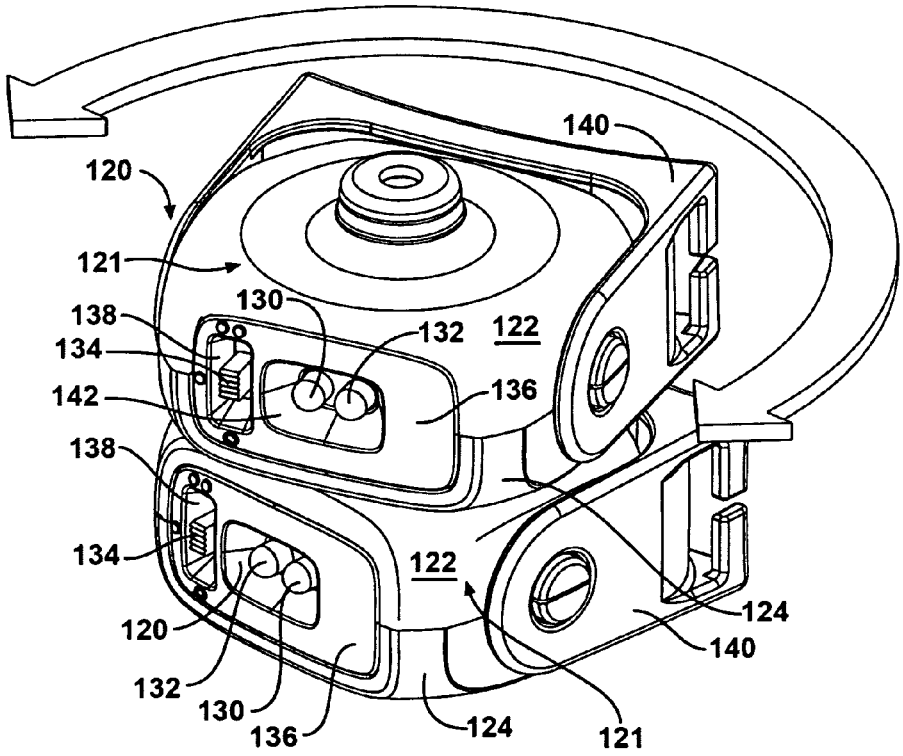
FIG. 16 illustrates a pair of the units of the alternative embodiment connected to one another and rotated relative to one another.
Figure 17:
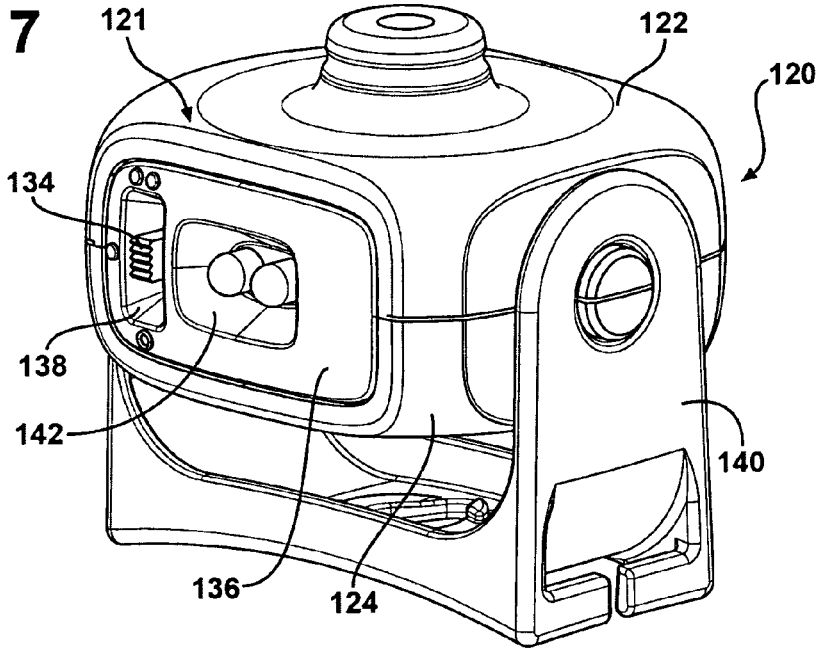
FIG. 17 is a perspective view of the unit.
Figure 18:
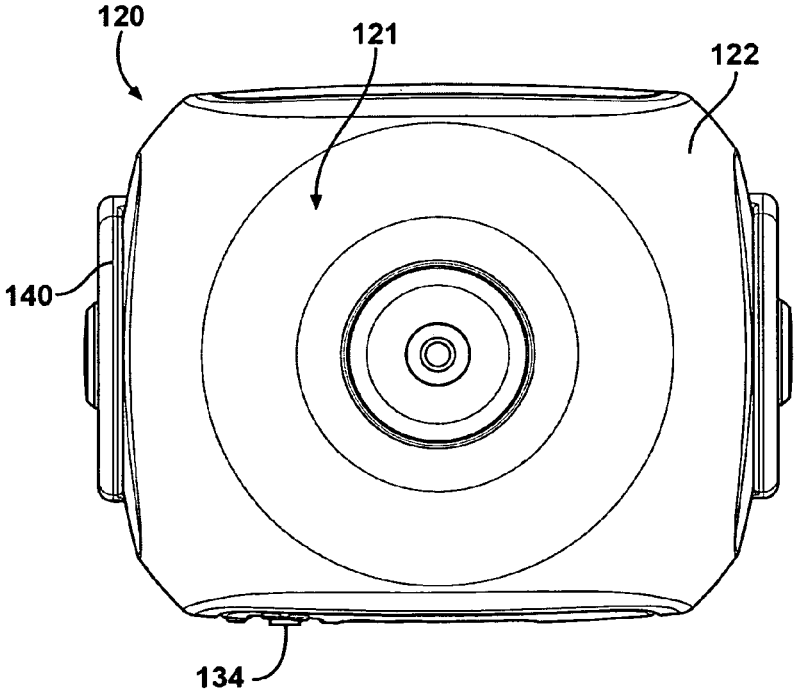
FIG. 18 is a top view of the unit shown in FIG. 17.

A bracket 42 is connected to each unit 12. The bracket is movable about the unit for placing the unit on a surface, such as a floor, a wall, or a ceiling and to position the unit 12 relative to the environment to be illuminated. As shown in FIGS. 1 and 2, the bracket 42 is movable relative to the unit 12 and is adaptable to be swinging over a bar 44, connected to a hook, or nailed to a surface. If the bracket 42 of the unit 12 is placed on a table, it can be used as a table lamp with the unit 12 being rotatable about 360 degrees as shown in FIG. 1. The unit 12 and the bracket 42 are injection molded from a polymeric material but may be formed from other materials without limiting the scope of the present invention.

FIGS. 12 and 13 show a generator unit 50 of the present invention. The generator unit presents a beam 52 having a first end defined by a first bar 54 and a second end defined by a second bar 56 and a seat 58 position relative the second bar 56. A generator block 60 is position on the beam 52 and is spaced from the seat 58. The block 60 is adaptable to mechanically generate power by moving pedals 62 and 64 without limiting the scope of the present invention. The generator block 60 presents a top portion 66 adaptable for receiving at least one of the units 12 thereby charging the unit 12 with power as the pedals 62 and 64 are movable about the generator block 60 for mechanically generating power inside the generator block 60 and translating the same to the units 12 thereby charging the units 12 with power enough to illuminate the environment for sufficient period of time. The generator 50 may also include a fuel cell, a battery, a solar panel, and other energy storing devices to supply power to the unit 12.

FIGS. 14 through 18 show various views of an alternative embodiment of the unit, generally shown at 120. A housing 121 presents a first portion 122 connected with a second portion 124. The first 122 and second 124 portions are removably connected with one another. A pair of power sources, i.e. batteries, 126 and 128, is placed inside the housing 121. A printed circuit board (PCB) 129 includes a pair of light emitting sources, i.e. light emitting diodes (LEDs) 130 and 132, and a switch 134 connected thereto. The board 129 is positioned inside the housing 121 and enclosed by a front panel 136 having an outlet 138 to expose the switch 134 and a pair or openings defined in a cavity 148 to expose the light bulbs 130 and 132. A bracket 140 is connected to the housing 121.

Figure 19:
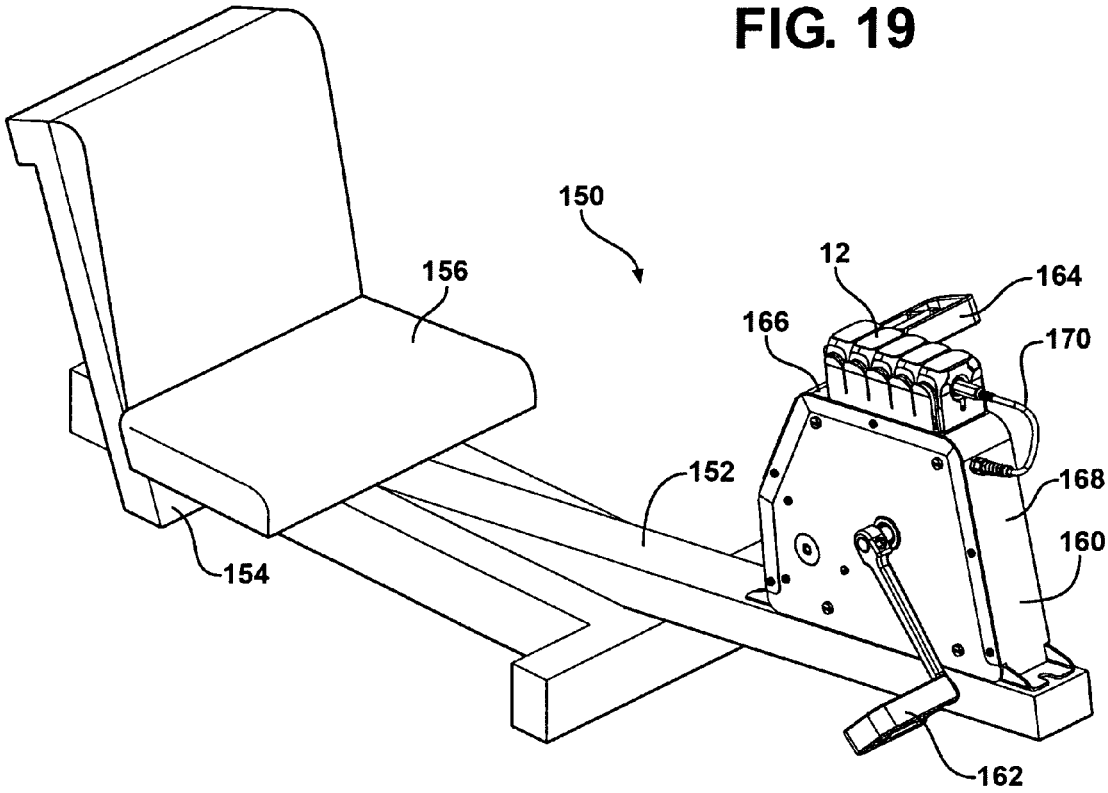
FIG. 19 shows a perspective view of an alternative embodiment of a self-propelled charging devices wherein the units are mechanically connected thereto and are charged by a user.
Figure 20:
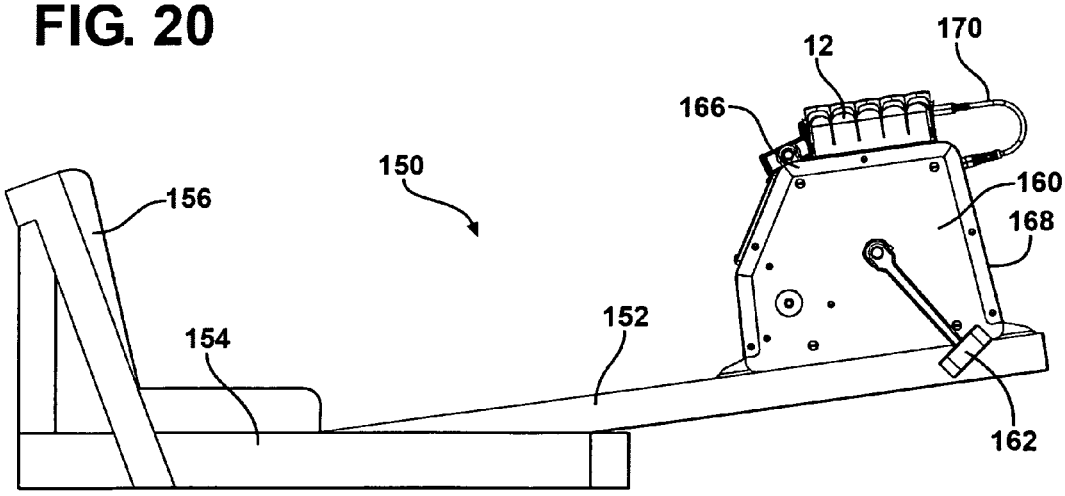
FIG. 20 shows a side view of the self-propelled charging device as shown in FIG. 19.

FIGS. 19 and 20 show an alternative embodiment of a generator unit of the present invention, generally shown at 150. The generator unit presents a beam 152 extending from a seat portion 154. A seat 156 is positioned on the seat portion 154. A generator block 160 is positioned on the beam 152 and is spaced from the seat 156. The block 160 is adaptable to mechanically generate power by moving pedals 162 and 164 without limiting the scope of the present invention. The generator block 160 presents a top portion 166, adaptable for receiving at least one of the units 12, and a side portion 168 having a connector 170 extending therefrom to be inserted into the female connector of the unit. The pedals 162 and 164 are movable about the generator block 160 for mechanically generating power inside the generator block 160 and translating the same to the units 12, thereby charging the units 12 with power enough to illuminate the environment for sufficient period of time. As one of the units 12 is charged, power is then transmitted through that unit 12 to other units mechanically engaged with one another.

An advantage of the present invention is to provide the illumination device 10 that is cost effective and easy to manufacture. Another advantage of the present invention is to provide the illumination device 10 that is easily transportable, compact in its design and can be easily assembled and installed to provide illumination at various angles. Still another advantage of the present invention is to provide the illumination device 10 that can be manipulated by reducing or increasing the number of units 12, 120 by mechanically mating the units 12, 120 with one another as more light is required and disassembling the units 12, 120 from one another to reduce illumination of the environment. Still another advantage of the present invention is to provide a cheap solution for every place in the world wherein electricity is in high demand and not affordable to some extent by everyone who needs it. The inventive concept of the device 10 is not limited to illumination purposes only. Each unit 12, 120 may include a radio, an air conditioning element, a fan, a watch with alarm mechanism, and any other device used for household purposes without limiting the scope of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An illumination device for illuminating an environment at various angles, said illumination device comprising:

at least two units each presenting a male connector and a female connector to mate with one another as more light is required and disassembled from one another to reduce illumination of the environment, wherein each unit includes a first portion removably connected to a second portion with said male connector defined in said first portion and said female connector defined in said second portion;

a bracket connected to each of said units, said bracket being movable about said unit for placing said unit on a surface and positioning said unit relative the environment to be illuminated; and said units removably connectable with one another and rotatable relative to one another for providing illumination about said units.

2. An illumination device as set forth in claim 1 wherein said first and second portions of said unit are fabricated from a polymeric material.

3. An illumination device as set forth in claim 2 including a light emitting source and a battery.

4. An illumination system for illuminating an environment at various angles comprising:

an illumination device including at least a first unit and a second unit with each unit presenting a male connector and a female connector with said male connector of one of said units mating with said female connector of another of said units as more light is required and disassembled from one another to reduce illumination of the environment;

a generator adaptable to mechanically generate power, and said generator presenting a top portion to receive said first unit for charging said first unit with power and for transmitting power to said second unit when said second unit is connected to said first unit, said generator presenting at least one lever movable about said generator for mechanically generating said power inside said generator.

5. An illumination system as set forth in claim 4 wherein said illumination device includes a bracket connected to each of said units, said bracket being movable about said unit for placing said unit on a surface and positioning said unit relative the environment to be illuminated.

6. An illumination system as set forth in claim 5 wherein each unit includes a first portion removably connected to a second portion with said male connector defined in said first portion and said female connector defined in said second portion.

7. An illumination system as set forth in claim 6 wherein said first and second portions of said unit are fabricated from a polymeric material.

8. An illumination system as set forth in claim 7 wherein said illumination device includes a light emitting source and a battery.

9. An illumination system as set forth in claim 4 wherein said generator has a beam defining said top portion extending between a first bar and a second bar and a seat.

10. An illumination system as set forth in claim 9 wherein said generator has a generator block mounted to said beam and spaced from said seat.

11. An illumination system as set forth in claim 10 wherein said lever is connected to said generator block and includes a pedal extending therefrom such that said generator block is adaptable to mechanically generate power by moving said pedals.

12. An illumination system as set forth in claim 11 wherein said generator block further defines said top portion.

13. An illumination device for illuminating an environment at various angles, said illumination device comprising:

at least two units each presenting a male connector and a female connector to mate with one another along a first axis as more light is required and disassembled from one another to reduce illumination of the environment, each of said units comprising a housing having a wall separating the male and female connectors;

a bracket connected to said wall of each unit at connection points defined between said bracket and said wall, wherein said bracket is movable about said unit relative to a second axis defined by said connection points with said second axis being transverse to said first axis, and wherein said bracket is movable relative to said unit about said second axis for placing said unit on a surface and positioning said unit relative to the environment to be illuminated; and said units removably connectable with one another and rotatable relative to one another about said first axis for providing illumination about said units.

14. The illumination device as set forth in claim 13 wherein each unit includes a first portion removably connected to a second portion with said male connector defined in said first portion and said female connector defined in said second portion.

15. The illumination device as set forth in claim 14 wherein said first and second portions of said unit are fabricated from a polymeric material.

16. The illumination device as set forth in claim 13 further including a light emitting source and a battery.

* * * * *